United States Patent [19]

Solomon et al.

[11] 4,148,325

[45] Apr. 10, 1979

[54] TREATMENT OF TOBACCO

[75] Inventors: Graeme R. Solomon; Eric J. Churcher, both of Southampton, England

[73] Assignee: British-American Tobacco Company Limited, London, England

[21] Appl. No.: 712,207

[22] Filed: Aug. 6, 1976

[30] Foreign Application Priority Data

Aug. 18, 1975 [GB] United Kingdom ..... 34299/75

[51] Int. Cl.[2] ..... A24B 3/00

[52] U.S. Cl. ..... 131/134; 131/136; 131/140 R; 34/68

[58] Field of Search ..... 302/29; 209/19–21; 259/4 R, DIG. 17; 99/323.4, 323.5, 323.6, 323.7, 323.8, 323.9, 472; 131/133, 134, 135, 136, 144, 138, 140 R, 140 P; 34/168, 169

[56] References Cited

U.S. PATENT DOCUMENTS

| | | | |
|---|---|---|---|
| Re. 29,298 | 7/1977 | Banks | 131/144 |
| 3,042,526 | 7/1962 | Spiess et al. | 34/168 X |
| 3,094,059 | 6/1963 | Graham et al. | 99/471 |
| 3,524,452 | 8/1970 | Moser et al. | 131/140 P |
| 3,529,606 | 9/1970 | de la Burde | 131/140 P |
| 3,548,838 | 12/1970 | Key | 131/136 |
| 3,697,286 | 10/1972 | Grün | 49/471 |
| 3,701,667 | 10/1972 | Takao et al. | 99/323.4 |
| 4,004,594 | 1/1977 | Wachnowski et al. | 131/140 P |

*Primary Examiner*—Robert W. Michell
*Assistant Examiner*—V. Millin
*Attorney, Agent, or Firm*—Kane, Dalsimer, Kane, Sullivan & Kurucz

[57] ABSTRACT

The invention concerns a method and apparatus for conditioning and/or drying or otherwise treating tobacco, in which cut tobacco is treated with a liquid and/or vapour medium in a chamber in which a columnar bed of the tobacco is maintained in a fluidized state by air, which may be heated. The treatment medium may comprise water, which is introduced as a spray into the bed and/or in co-current with the fluidizing air through diffusing means at the bottom of the bed, and/or steam. The tobacco may be treated in continuous flow or batchwise.

15 Claims, 2 Drawing Figures

TREATMENT OF TOBACCO

This invention concerns a method and apparatus for treating cut tobacco, particularly for conditioning and-/or drying tobacco stems and/or lamina.

In conjunction with treatment with alkali, it is known to use a bed fluidized with steam to remove nicotine from damp ground tobacco. It is also known to use the fluid-bed principle with hot air for drying tobacco, or for puffing wet stems, on a vibrating conveyor belt or in a drum.

The present invention seeks, in particular, to provide a method for conditioning and/or drying tobacco which requires relatively simple, compact, apparatus, which is economical, inter alia, with respect to air required in proportion to the weight of tobacco treated, and which is versatile both with respect to the possible treatments which can be performed and to the manner in which they can be carried out. The invention also provides apparatus suitable for carrying out the method.

According to the present invention, a method for conditioning and/or drying tobacco comprises treating cut tobacco with a liquid and/or vapour medium in a chamber in which a columnar bed of the tobacco is maintained in a fluidized state by a gaseous fluidizing medium, namely air. By a columnar bed in this specification and the appended claims is meant one in which the depth of the fluidized bed is greater than its mean dimension in a horizontal plane, i.e. the diameter in the case of an upright cylindrical chamber. The ratio of the depth of the bed to the aforesaid dimension will preferably be within a range of 2:1 to 5:1. Treatment in a columnar fluidized bed is to be distinguished from treatment in which tobacco is dried while being conveyed upwardly by a large volume of air through a vertical chamber.

The tobacco treated may be cut rolled stems or lamina, generally cut to a shred size suitable for cigarette manufacture, for example from 1 cut per mm to 8 cuts per mm. The treatment medium may comprise water and/or steam or other vapour, or a combination or mixture of water with air or with steam and air. The treatment medium may also comprise or consist of a liquid, or liquid-borne, flavorant or additive. The fluidizing air itself may be heated or unheated and may be wet or dry depending on the requirements of the process to which the tobacco is to be subjected. The method may be applied in either a continuous flow or batch type of process.

The method set forth permits, in both flow and batch process, of a close approach to so-called "perfect mixing" (as hereinafter defined) of the tobacco and treatment medium. A product of required uniform moisture content can readily be obtained and processing time can be short. The apparatus required is smple and involves little loss of time for maintenance.

Preferably, for either continuous-flow or batch operation, the chamber comprises a main section of cylindrical form, but is surmounted by a flaring upper section facilitating disengagement of the fluidizing air from the tobacco. The fluidized bed is then mainly within the cylindrical section, say as to 80% of the depth of the bed, but extends into the upper section. The upper section may be open at the top, except for a tobacco-restraining screen, but is preferably covered and provided with an air outlet above the screen. A diffuser of perforated or porous material is provided at the bottom of the chamber. The tobacco is fluidized by blowing air, which may be at ambient temperature, through the diffuser into the bottom of the chamber. Simultaneously the treatment medium, for example water atomised with air or a fine spray of water under pressure, or steam is introduced into the tobacco in the chamber, co-current and/or counter current in relation to the air, through the wall or the bottom of the chamber. By this treatment, tobacco lamina or stems having a required moisture content can be produced depending upon the period of residence of the tobacco in the chamber.

In the case of continuous-flow treatment, the tobacco simply passes continuously through the chamber. For batch treatment, the chamber is first charged, say to one third of its height, with the tobacco, which may be dry or have a moisture content up to 60% on a wet-weight basis. The charge is then brought to the columnar-bed state by blowing in fluidizing air and the water or other treatment liquid is introduced, both as described above. The treatment may be continued for 10 seconds to 1 hour, depending on the size of the chamber, the volume of the charge and the rate of liquid addition required, which may be up to 2 liter/min per kg of the charge.

If required, with either form of treatment, steam may be used to condition the tobacco before, during or after the water-spray treatment. The temperature of the tobacco can thus be raised and a humid atmosphere maintained within the chamber. If steam is used in conjunction with preheated air, the temperature of the tobacco can be raised to 100° C. or more, giving conditions suitable for subsequent attainment of increased filling power by exapnsion of the tobacco. In conjunction with the water treatment, improved filling power can be achieved, apparently due to a relaxation effect.

After the aforesaid water treatment, the tobacco may be dried or otherwise further treated as required, possibly as a fluidized bed in the same chamber in the case of batch treatment or, in either form of treatment, in a further, similar, fluidized columnar-bed chamber. For drying in the former case, the moist tobacco may be brought again into fluidized-bed suspension by blowing air at a temperature of from 20° C. to 100° C. or more into the chamber at the bottom, whereby drying a required extend can be effected within a period of from 10 seconds to 1 hour. In the case of continuous-flow treatment, the tobacco may be treated with air at similar temperatures while passing continuously through a further columnar fluid-bed chamber to which it is fed from the water-treatment chamber. Drying is achieved under nearly isothermal conditions. Alternatively, instead of being dried by hot air, the tobacco may be dried, while in a fluidized state, by microwave energy.

The method is versatile even when used for batch treatment, but is advantageously applied in continuous-flow treatment, in which case the tobacco is continuously fed pneumatically or under gravity into the chamber, resides therein as a fluidized columnar bed and is discharged continuously from the chamber, whence it may be conveyed away pneumatically or under gravity.

As previously indicated, the method may be employed also for the treatment of cut tobacco with a flavorant or other tobacco additive. If such additive is not in a liquid form suitable for spraying into the fluidized bed in the chamber, it may be introduced with the assistance of water or another fluid carrier.

One manner of carrying the invention into effect will now be more fully described, by way of example, with reference to the accompanying drawings, in which.

Figure 1:
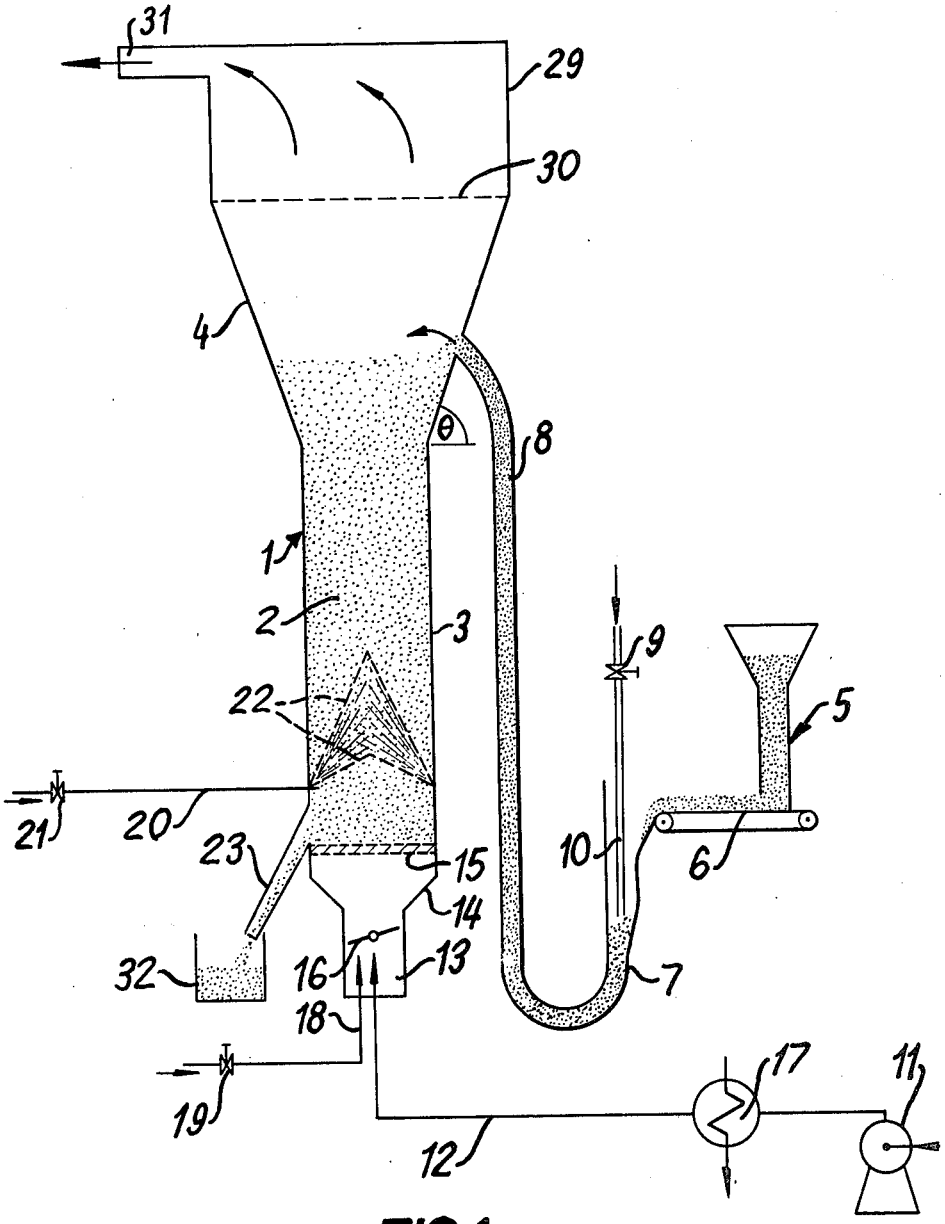
FIG. 1 is a diagram of apparatus intended for continuous-flow treatment.

The apparatus illustrated in FIG. 1 comprises a vertical chamber 1 in whichn, in operation, a columnar bed 2 of cut tobacco is maintained in a fluidized state by air introduced at the bottom of the chamber as hereinafter described. The chamber comprises a main cylindrical section 3 surmounted by a shorter conical section 4. Preferably, the internal diameter of the cylindrical section 3 is not less than 30 cm and the angle $\theta$ of the conical section 4 is preferably not less than 70° or more than 80°. With such a chamber, there is an appreciable reduction in upward air velocity in the section 4, suitably by a factor of 2, which facilitates disengagement of the air from the tobacco, although the effective fluidized bed extends into that section from the section 3. With the bed illustrated, the ratio of the depth of fluidized bed to the internal diameter of the chamber section 3 will be between 3.5:1 and 4:1.

Cut tobacco is supplied to the chamber 1 from a column-type feeder 5 having an endless conveyor band 6 whose speed of advance can be controlled. The band 6 delivers the tobacco into one limb 7 of a U-pipe whose other limb 8 discharges continuously into the upper chamber section 4. The tobacco is forced through the pipe by a jet of compressed air, controlled by a valve 9, directed from a pipe 10 into the limb 7.

Compressed air for fluidizing the bed 2 is supplied by a fan 11 through a pipe 12 to a chamber 13 below the fluidization chamber 1, to which it is connected through a conical transition 14. A diffuser pad 15 of a material pervious to air separates the bed 2 from the chamber 13. An adjustable butterfly valve 16 by which the supply of fluidizing air can be controlled is provided in the chamber 13.

If heating of the air is or may be required, a controllable heater 17, for example a steam-heated heater, is provided on the pipe 12.

Steam may be introduced with the fluidizing air. As illustrated, such steam is injected co-current with air from a pipe 18 having a control valve 19. Alternatively or in addition, provision (not illustrated) may be made for injecting steam into the main body of the fluidized columnar bed 2 in the chamber section 3.

Provision is also made for introducing water into the fluidized tobacco bed 2. As illustrated, water supplied by a pipe 20 and controllable by a valve 21 is sprayed under pressure into the tobacco from a nozzle or ring of nozzles the apertures of which are located around the interior of the chamber section 3. The boundaries of the cross section of a suitable spray pattern 22 are indicated by broken lines. Alternatively or in addition, water may be introduced at other places, for example at the base of the bed 2 or downwardly into the latter, or a combination of these modes may be provided for, the number of nozzles employed for each mode depending upon the requirements. If desired, the water may be introduced into the fluidized bed 2 together with the water or in a similar fashion, in the latter case in liquid form or, if necessary, with the assistance of a carrier fluid.

Tobacco, having progressed downwardly through the fluidized columnar bed 2 is discharged from the lower end of the chamber section 3 through a downwardly directed duct 23.

Figure 2:
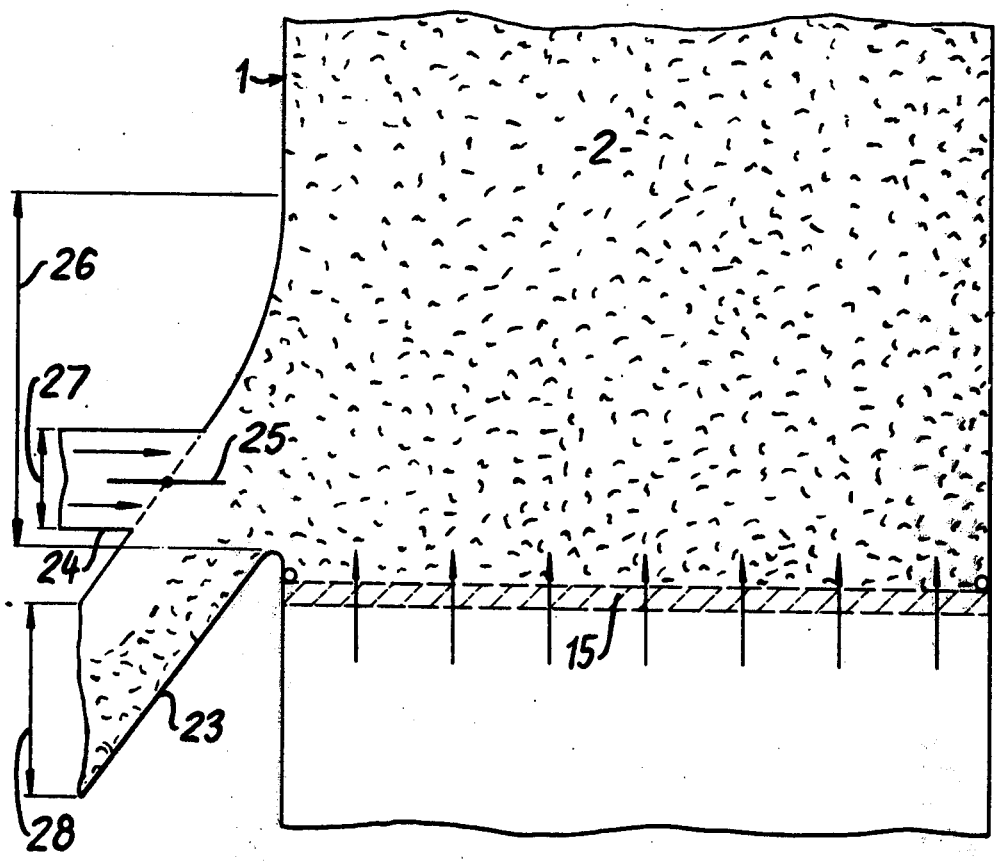
FIG. 2 illustrates to a larger scale a preferred form of tobacco-discharge means for that apparatus.

In the continuous-flow apparatus described above, it is important that discharge should occur at a required even rate. If the discharge opening is too large, the whole contents of the chamber 1 may be discharged too rapidly. If the opening is too small, it may tend to become blocked by congestion of tobacco in its vicinity. Difficulty in this respect can be avoided by the arrangement shown in FIG. 2, in which there is provision for the introduction of a controllable flow of compressed air at the junction between the discharge duct 23 with the chamber 1. This air flow is introduced through a horizontal pipe 24 at whose mouth a butterfly valve 25 is provided. In the fully open position of the valve (shown by a full line), the air flow will be at a maximum and, as a result of the resistance offered by it to the tobacco, the rate of discharge of the latter will be at a minimum. As the valve 25 is turned towards its closed position (shown by a broken line), the air flow will be progressively reduced and the rate of tobacco discharge increased. The discharge rate can thus be controlled, within adequate limits, by adjusting the valve 25 to intermediate positions. When the valve 25 is at or near the closed position however, the discharge duct 23 may tend to become congested and blocked, which contingency can be avoided by limiting the degree of closure of the valve. As illustrated in FIG. 2, the vertical dimensions 26, 27 and 28 of the chamber-to-duct transition, the air pipe 25 and the discharge duct 23 respectively are in suitable proportions.

Reverting to FIG. 1, the upper chamber section 4 is surmounted by an air chest 29 from which it is separated by a wire mesh screen 30 for preventing loss of tobacco. The over-all height of the chamber structure is still of a moderate acceptable order. The air outlet 31 may lead to a dust extractor by which tobacco dust can be removed. The discharge duct 23 is shown diagrammatically as discharging into a receptacle 32. As will be apparent, however, the discharge may be directly to apparatus for a further treatment stage or stages.

Thus, if the tobacco is to be further treated to increase its filling power, two further chambers, generally similar to the chamber 1, are connected in series with it with respect to the flow of the tobacco therethrough. In the first further chamber, fluidizing air, introduced via 12 as in FIG. 1, is heated, as is water, introduced via 20, which is sprayed into the columnar bed 2. The effect of the hot water is to expand the tobacco particles. The tobacco discharged, via duct 23, from the base of the chamber 1 is conveyed pneumatically to the upper part of the second further chamber, in which a fluidized columnar bed is maintained by hot, dry, air, whereby the tobacco is dried. The hot dry tobacco is then passed to a cooler, which may take the form of a third, similar, chamber in which a fluidized columnar bed is maintained by cool fluidizing air. The residence time in such chambers will generally be within a range of one-half to 5 minutes. A separate cooler may not be required, if cooled, dry, fluidizing air is supplied to the second chamber. The drying stage may alternatively be provided by microwave energy applied to the tobacco in per se known manner in a columnar fluidized-bed or in other apparatus.

Naturally the method of the invention may be applied simply to the treatment of tobacco to increase its filling power and comprising stages such as have just been described.

The above description is concerned with apparatus for continuous-flow operation in which a close approach is made to "perfect mixing". By perfect mixing is meant mixing such that the temperature and moisture content of the tobacco within the chamber are uniform and equal to the temperature and moisture content thereof at discharge. Material entering the columnar bed is immediately mixed with the material of which the bed is already composed, the resultant mixture having at all points the composition with which it is being discharged. A basically similar chamber may be used for batch operation, in which a close approach to "perfect mixing" is also made. The material of the batch has, at any particular time, a substantially identical composition throughout, this composition progressing to the required final composition at which the batch is discharged. A specific example for batch operation will now be described.

Use was made of a fluidization chamber, generally similar to the chamber 1, comprising a cylindrical section of 30 cm internal diameter and 90 cm height surmounted by a steeply conical section, 70 cm high, covered by a removable fine-mesh screen. Connected to the bottom of the chamber and separated from it by a diffuser pad was a lower chamber of 15 cm internal diameter widening to the 30 cm diameter of the fluidization chamber. This lower chamber, as in FIG. 1, accommodated the means for introducing the fluidizing air. It also accommodated means for injecting water comprising a supply pipe, of 4 mm internal diameter, leading to a nozzle mounted in the diffuser pad, without protruding into the fluidization chamber, so as to inject a water mist into the latter.

A batch of rolled stems cut to 6 cuts/mm and having a moisture content of 15.8% by weight, with a standard deviation of 0.22%, was placed in the fluidization chamber, giving a static depth of 30 cm therein which was sufficient to provide a fluidized columnar bed occupying the cylindrical section and extending into the upper conical section to give a height to diameter ratio of fluidized bed of about 3.5 to 4:1.

For producing the columnar fluidized bed, air at room temperature was passed upwardly through the chamber at a volumetric flow rate of 0.26 $m^3$/second, corresponding to a linear air velocity of 3.6 m/second at the base of the chamber. Water was introduced at a flow-rate of 6.7 ml/second and the water pressure in the supply pipe was 4.5 $kg/cm^2$ (absolute). These conditions were maintained for five minutes. The static depth of the tobacco in the chamber after termination of this treatment was 25 cm and the moisture content 49.71% with a standard deviation of 0.11%.

We claim:

1. A method for treating tobacco, comprising treating cut tobacco with a fluid medium in a chamber in which a columnar bed of the tobacco, that is a bed whose depth is greater than its mean horizontal dimension, is maintained in a fluidized state by air, the air flowing through the bed of tobacco with a velocity higher than the incipient fluidizing velocity but lower than the entrainment velocity.

2. A method for conditioning tobacco according to claim 1, wherein the treatment medium comprises water which is introduced as a spray into the fluidized columnar bed in the chamber.

3. A method for conditioning tobacco according to claim 1, wherein the treatment medium comprises water which is introduced in co-current with the fluidizing air through diffusing means at the bottom of the fluidized columnar bed.

4. A method according to claim 1, wherein steam is introduced into the fluidized columnar bed.

5. A method according to claim 1, wherein steam is introduced into the fluidized columnar bed in co-current with the fluidizing air through diffusing means at the bottom of the bed.

6. A method according to claim 1, wherein the fluidizing air is heated air.

7. A method according to claim 1, wherein the tobacco is treated as a fluidized columnar batch in the chamber.

8. A method of increasing the filling power of tobacco according to claim 1, wherein the tobacco is treated with steam or with steam and heated air in a columnar bed maintained in a fluidized state by air.

9. Apparatus for treating tobacco, comprising a columnar chamber, means for introducing air to the bottom of the chamber for maintaining a columnar bed of cut tobacco, that is a bed whose depth is greater than its mean horizontal dimension, in a fluidized state in the said chamber, the air flowing through the bed of cut tobacco with a velocity higher than the incipient fluidizing velocity but lower than the entrainment velocity, and means for introducing a treatment medium into the said fluidized bed in the chamber.

10. Apparatus according to claim 9, wherein the means for introducing the treatment medium comprises means for spraying water into the columnar fluidized bed in the chamber.

11. Apparatus according to claim 9, wherein the means for introducing the treatment medium comprises means for introducing water in co-current with the fluidizing air through a diffuser at the bottom of the chamber.

12. Apparatus according to claim 9 and comprising means for introducing steam into the chamber.

13. Apparatus according to claim 9 and comprising means for heating the air supplied to the chamber for fluidizing the bed.

14. Apparatus according to claim 9 and comprising continuously operating tobacco-feeding and discharge means, whereby the tobacco is caused to pass continuously through the chamber in counter current to the fluidizing air.

15. A method for treating tobacco, comprising treating cut tobacco with a fluid medium in a chamber in which a columnar bed of the tobacco, that is a bed which depth is greater than its mean horizontal dimension, is maintained in a fluidized state by air, and the tobacco passes through the chamber in a continuous flow counter to the direction of the fluidizing air.

* * * * *